US005117657A

United States Patent [19]

Tissari

[11] Patent Number: 5,117,657

[45] Date of Patent: Jun. 2, 1992

[54] MACHINE FOR WASHING OF CARPETS

[76] Inventor: Osmo Tissari, Orakaskuja 3, SF-70910 Vuorela, Finland

[21] Appl. No.: 688,585

[22] PCT Filed: Dec. 27, 1989

[86] PCT No.: PCT/FI89/00241

§ 371 Date: Jun. 27, 1991

§ 102(e) Date: Jun. 27, 1991

[87] PCT Pub. No.: WO90/07604

PCT Pub. Date: Jul. 12, 1990

[30] Foreign Application Priority Data

Dec. 29, 1988 [FI] Finland ..... 886022

[51] Int. Cl.[5] ..... D06B 1/02

[52] U.S. Cl. ..... 68/20; 68/205 R; 118/323

[58] Field of Search ..... 68/205 R, 20; 134/64 R, 134/167 R, 172; 239/173, 174, 210; 118/323

[56] References Cited

U.S. PATENT DOCUMENTS

| | | | |
|---|---|---|---|
| 3,985,161 | 10/1976 | Nelson | 118/323 X |
| 4,209,557 | 6/1980 | Edwards | 118/323 X |
| 4,576,113 | 3/1986 | Kambara et al. | 118/323 X |
| 4,799,368 | 1/1989 | Tissari | 68/205 R X |

FOREIGN PATENT DOCUMENTS

| | | | |
|---|---|---|---|
| 1293563 | 4/1969 | Fed. Rep. of Germany . | |
| 1007749 | 3/1983 | U.S.S.R. | 118/323 |

*Primary Examiner*—Philip R. Coe

*Attorney, Agent, or Firm*—Cushman, Darby & Cushman

[57] ABSTRACT

A machine for washing carpets having a frame, a plurality of elongated rolls located in the frame for transferring the carpet through the machine, and a distributing unit mvoable along the length of the rolls for spraying cleaning solution on the carpet. The machine also includes hoses connected at one end to the distributing unit, and at the other end, to a transportation device. The transportation device is movable, which moves the hoses, which in turn moves the distributing unit along the length of the rolls.

7 Claims, 3 Drawing Sheets

MACHINE FOR WASHING OF CARPETS

BACKGROUND OF THE INVENTION

In conventional carpet washing machines the distributing unit for the detergent fluid and the scavenging agent are transferred in the direction of the rolls and with the nozzles of the distributing unit, the detergent fluid and/or the scavenging agent are sprayed on the surface of the carpet. In these machines, a separate source of power and a mechanism is needed for moving the distributing unit. This moving mechanism is positioned inside the frame of the machine and forms a part of the distributing unit. The mechanism, disposed inside the frame, is subject to very humid conditions and it is either expensive or undependable. The drying devices are positioned after the rolls and arranged to blow dry air on the surfaces of the carpets. The dryers used in conventional carpet washing machines are not efficient.

The purpose of the invention is to provide a machine for washing carpets, wherein the distributing unit of the detergent fluid and/or the scavenging agent is arranged to be moved by a simple and cost effective construction. Additionally, the aim with the invention is to provide a machine for washing carpets, wherein the drying device is simple in construction and efficient.

SUMMARY OF THE INVENTION

30 The goal of the invention is achieved by providing a machine for washing carpets, to which belongs a frame, inside the frame placed rolls, supported on which, the carpet is arranged to be transferred in the machine, inside the frame is positioned, in the length direction of the rolls, a movable distributing unit for detergent fluid and scavenging agent for spraying the detergent fluid and the scavenging agent on the surface of the carpet, and connected to the distributing unit are hoses for the detergent fluid and the scavenging agent, which are led from the inside of the frame out.

In the machine in accordance with the invention, the hoses of the detergent fluid and the scavenging agent are outside the machine at one end and connected with a transportation device fastened on the frame. The transportation device is arranged to transfer the hoses which in turn moves a distributing unit connected to the other end of the hoses. The transportation device is positioned outside the frame and does not exist in humid conditions. The rolls are placed inside the frame. The hoses are moved simultaneously (one for the transferring of the detergent fluid and the other the scavenging agent) to the distributing unit for the moving of the distributing unit. In the machine in accordance with the invention one advantage is that the hoses are always straight inside the frame, so that they are not bowed into sharp angles and break easily as they do in conventional machines.

BRIEF DESCRIPTION OF THE DRAWINGS

The present invention will be explained in more detail by referring to the attached drawings in which.

DETAILED DESCRIPTION OF THE INVENTION

Figure 1:
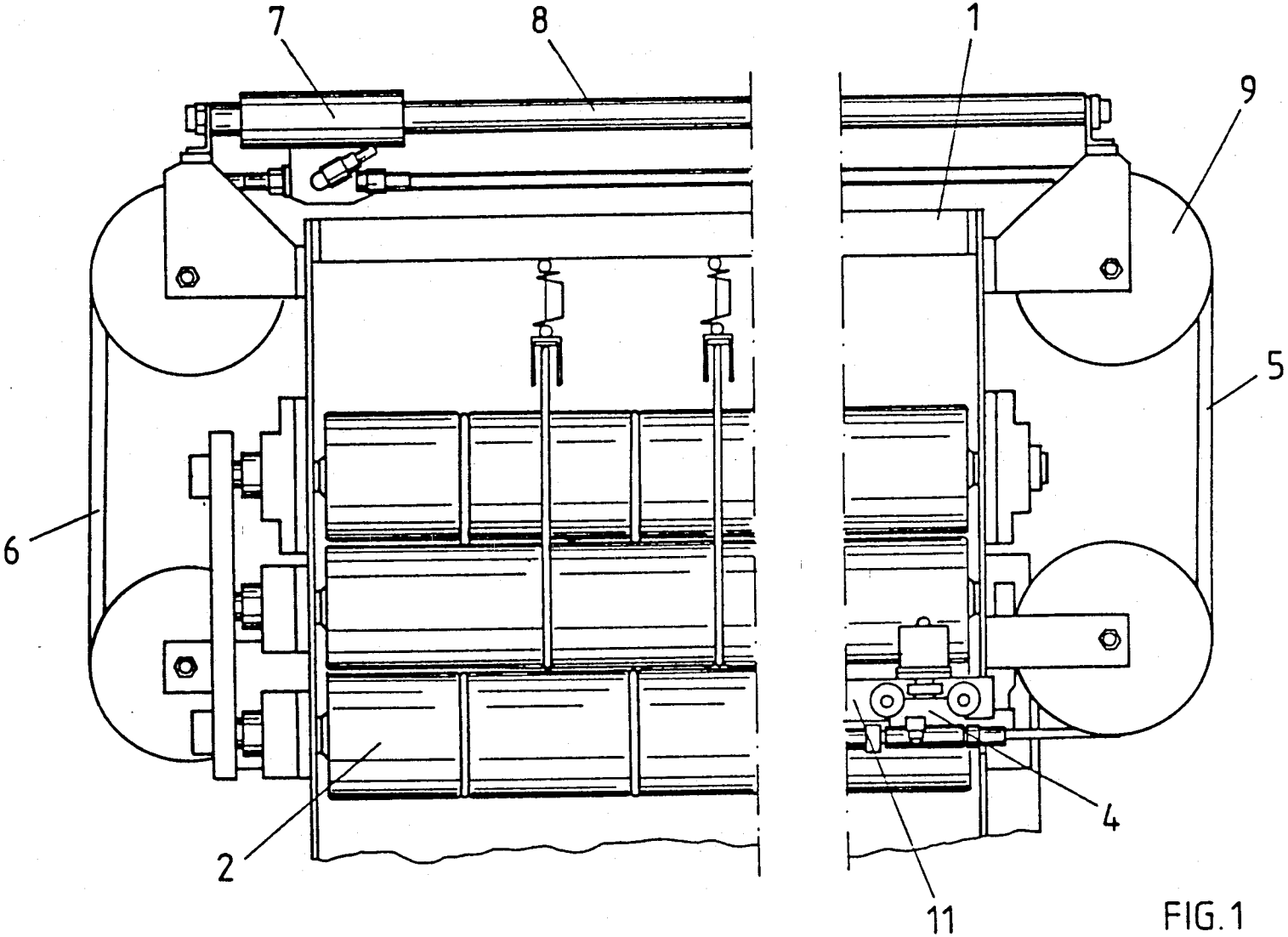
FIG. 1 presents an embodiment of the machine for washing carpets in accordance with the invention seen from the side in two different cutthroughs.
Figure 2:
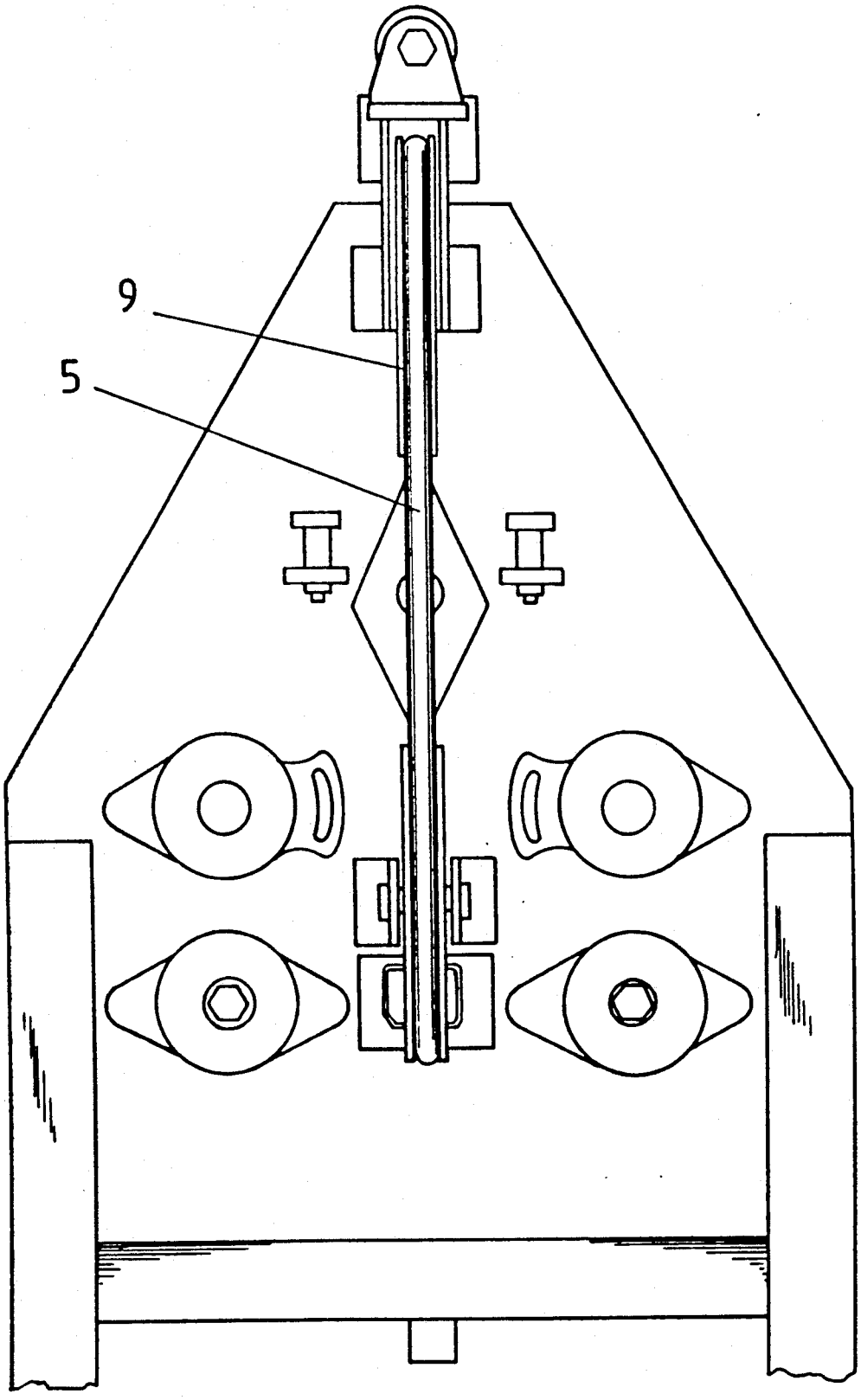
FIG. 2 presents the machine in accordance with FIG. 1 seen from the gable.
Figure 3:
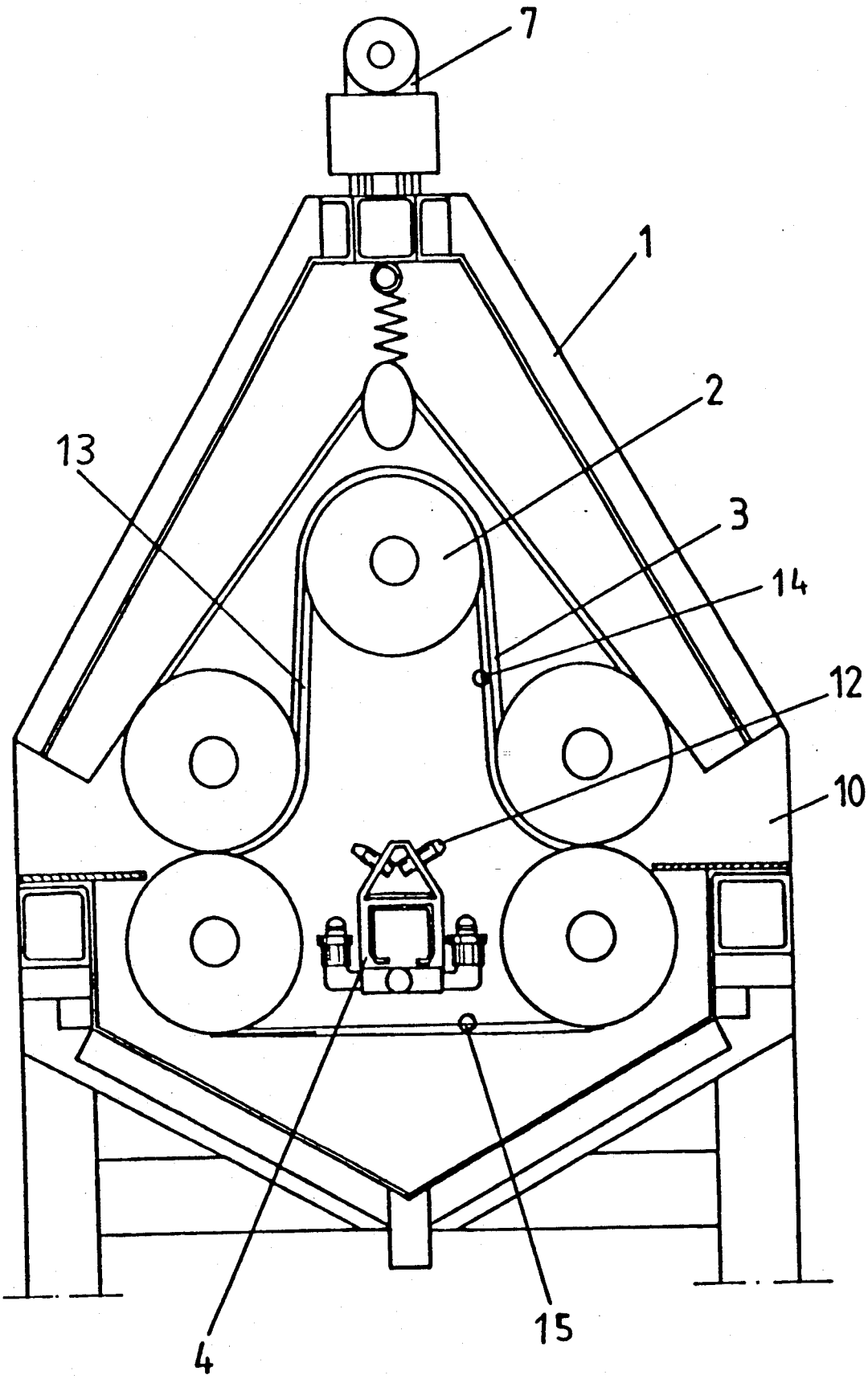
FIG. 3 presents the machine in accordance with FIG. 1 seen from the gable with the gable cover opened.

In the embodiment in accordance with FIGS. 1-3 a machine for washing carpets is shown. The machine has a frame 1. Disposed inside the frame are rolls 2, a distributing unit 4, hoses 5, 6, which have been led from the inside of the frame to the outside. Outside the frame is placed a transportation device 7. In this embodiment, the machine has five rolls 2, four rolls have been arranged by pairs with the fifth placed in the middle of the roll pairs at a distance therefrom. In accordance with the FIG. 3, the carpet 3 is fed into the machine from an opening on the left side of the frame 1, transferred inside the machine supported by the rolls 2 and fed-out through the opening 10 on the right side of the machine. The distributing unit 4 for the detergent fluid and the scavenging agent is placed between the rolls 2 and it is moved inside the frame 1 supported by the rails 11 in the lengthwise direction of the rolls. On one end of the distributing unit, the hose 5 is connected, transporting the detergent fluid. The other end the hose 6 transports the scavenging agent. Nozzles 12 of the distributing unit are directed in two directions. The nozzles directed in one direction are connected with the detergent fluid hose and in the other direction, the nozzles are connected with the scavenging agent hose. The carpet lies bowed on the rolls, with the filaments of the part of the carpet on top of the rolls, being open. The detergent fluid and the scavenging agent nozzles are aimed at the bowed spots so that the detergent fluid and the scavenging agent can have an efficient influence on the carpet. The detergent fluid hose 5 and the scavenging agent hose 6 are led form the inside of the frame out, supported on the supporting elements 9 fixed on the sides of the frame 1, which, in this embodiment are wheels. The supporting elements 9 are fastened from their one end on the transportation device 7, which is fixed movably on the frame 1. The hoses form an endless looping with the supporting elements 9, because their one end is fastened on the distributing unit 4 and the other end is connected to the transportation device 7. The lengths of the detergent fluid hose and the scavenging agent hose are mainly equal. The machine includes a supporting bar 8 disposed on top of the frame, extending in the length direction of the rolls. The transportation device 7 is movably fastened on the supporting bar. The transportation device 7 is moved in about the supporting bar 8 in a known manner, for instance with the help of a cylinder or the like. The detergent fluid hose 5 and scavenging agent hose 6 are led from the outside of the machine, connected with the transportation device 7 at one end and connected to the distributing unit 4 at the other end.

When operating the machine, the transportation device 7 is transferred with the help of a power source supported on the supporting bar 8. The detergent fluid hose 5 and the scavenging agent hose 6 are transferred along with the transportation device 7. Also, the hoses 5, 6 with their other end connected to the distributing unit, move inside the frame simultaneously.

Belts 13 are positioned between the rolls 2 at a suitable distance from each other. The carpet is supported on the belts 13 while the carpet is transferred inside the machine. Between the middle roll and the scavenging rolls have been placed guiding devices 14, which are arranged to transfer the positions of the belts in regard of the carpet. Consequently, the spot situated underneath the belt will be scavenged in an efficient way. Between the washing and the scavenging rolls second guiding devices 15 are positioned, which are arranged to transfer the belts back again. In an embodiment of the transportation device, a net is used.

In a second embodiment of the invention, a washing and scavenging device is disposed inside the middle of the frame, above the roll, the structure and function of which correspond to the unit described above. The carpet can be washed efficiently on both the sides in this embodiment.

A machine in accordance with the invention is particularly aimed for washing of non-woven mats. In a preferred embodiment of the invention, the machine includes a drying device disposed outside the frame. The drying device is positioned, in the length direction of the rolls and includes movable drying air blower or a corresponding device. With the drying fan air is blown on the surface of the carpet. The drying device includes a roll or rolls, on which the carpet is laid in a bowed position, to facilitate efficient drying. The air blower is connected with the transportation device described above by means of drying air hoses and is moved in the same manner as the distributing unit, simultaneously in the transverse direction of the carpet.

In another embodiment of the invention, the drying device includes rolls (not presented in the figures), between which the carpet is directed after the scavenging rolls. Between these rolls the carpet is pressed as dry as possible. The drying is continued afterwards by means of a drying air blower or with a corresponding drying device. The drying rolls are pressed against each other along their entire length with pneumatically or hydraulically controlled pressing units, which are positioned on the surfaces of the rolls. The pressing unit is preferably a hose like element stretching in the length direction of the rolls, which is pressed evenly against the rolls. As an alternative, individual pressing units may be used or to it may include several disposed at a distance from each other, positioned on the surface of the roll. These rolls are not pressed against each other from the ends only, but from the middle part as well. The carpet coming from between the rolls is mainly equally drying its every spot with drying taking place evenly.

The invention is not limited to the embodiments presented here, but it can vary within the spirit of the claims.

I claim:

1. A machine for washing carpets comprising:

a frame, a plurality of elongated rolls disposed inside said frame for transferring a carpet through the machine, a distributing unit movable along the length of said rolls for spraying cleaning solution on the carpet, first and second hose members respectively for carrying detergent solution and a scavenging agent and having first and second ends, said first ends being connected to said distributing unit, said second ends extending through said frame, a transportation device disposed outside of said frame and affixed thereto, said second ends of said hoses being affixed to said transportation device so that movement of said transportation device moves said hoses, which in turn moves said distributing unit along said length of said rolls.

2. A machine as claimed in claim 1, wherein said hoses are arranged in a continuous loop, first first hose and said second hose being disposed on opposite sides of said frame.

3. A machine as claimed in claims 1 or 2, wherein said transportation device is movable fastened in a supporting bar extending parallel to said rolls.

4. A machine as claimed in claim 1, further comprising supporting elements affixed to said frame for supporting said first and second hoses thereon.

5. A machine as claimed in claim 1, further comprising a drying device disposed on said frame, said drying device including nozzles for blowing air on the surface of the carpet, said nozzles being connected to said transportation device outside said frame, said nozzles being transferred in the transverse direction of the carpet by said transportation device.

6. A machine as claimed in claim 1, further comprising belts disposed between said rolls, said belts supporting the carpet while the carpet is transferred in the machine.

7. A machine as claimed in claim 6, further comprising first and second guiding devices, said first guiding device for changing the position of said belts from an initial position to a new position, said second guiding belt for returning said belts to said initial position.

* * * * *